United States Patent [19]

O'Keefe et al.

[11] 4,170,051

[45] Oct. 9, 1979

[54] HYDRAULIC AND MECHANICAL PUNCH HOLDER ADJUSTMENT

[75] Inventors: George F. O'Keefe, Southington; Donald A. Roy, Waterbury; Erwin B. Byam, Wolcott, all of Conn.

[73] Assignee: Textron Inc., Providence, R.I.

[21] Appl. No.: 845,126

[22] Filed: Oct. 25, 1977

[51] Int. Cl.[2] ..... B21K 1/44

[52] U.S. Cl. ..... 10/12.5

[58] Field of Search ..... 10/11 R, 11 A, 12 R, 10/12.5, 15, 72 R, 76 R; 72/352, 354, 361

[56] References Cited

U.S. PATENT DOCUMENTS

| | | | |
|---|---|---|---|
| 1,012,341 | 12/1911 | Duston | 10/12.5 |
| 1,024,046 | 4/1912 | Weeks | 10/12 R |
| 1,286,468 | 12/1918 | Wilcox | 10/12.5 |
| 2,104,297 | 1/1938 | Friedman | 10/12.5 X |
| 2,275,665 | 3/1942 | Wilcox | 10/12.5 |
| 2,296,693 | 9/1942 | Wilcox | 10/12.5 |
| 2,322,262 | 6/1943 | Tomalis | 10/12.5 |
| 3,260,096 | 7/1966 | Sakamura | 10/12.5 X |
| 3,559,446 | 2/1971 | Dom et al. | 10/12 R X |

*Primary Examiner*—E. M. Combs

*Attorney, Agent, or Firm*—DeLio and Montgomery

[57] ABSTRACT

Mechanism for effecting the fine adjustment of punch holders in a header or the like, which mechanism can be actuated from a readily accessible position on the machine, remote from the punch holder, and the mechanism being either entirely mechanical or partially hydraulic; supplemented by an alternative lock-up mechanism for use with punch holder studs for remote release of the holders to permit fine adjustment.

16 Claims, 14 Drawing Figures

VI
VI
14
20
21
22
23
24
24'
25
25'
26
26'
27
28
28'
30
31
32
32'
33
34
35
36
37
38
39
40
41
42
43
45
46
47
48
49
50
51
52
115
116
117
120
121
122
123
124
125

14
137
138
136
180
182
183
165
166
162
164
176
203
201
204
173
174
X
174
175'
175
176
165
201
203
204
203
173
162
160
137
202
138
136
134
156
128
161
161'
154
132
152
142
130
140
141
153
133
131
177
200
173
172
174'
196
135
170
171'
171
155
144
197
191
195
145
146
190
198
128
199
X 184
183
182
181
185
180
136
150
132
140
140
133
151
144
128
134
135
184
185
183
182
181
180
132
136
194
165
163
166
163'
164
173
174
175'
201
175
176
203
203
204
162
202
160
154
161
156
140
140
200
177
172
174'
173
170
155
157
171
194
196
197
144
193
191
192
195
198
194
190
199

HYDRAULIC AND MECHANICAL PUNCH HOLDER ADJUSTMENT

This invention relates to headers or like machines wherein one or more dies are carried by the frame of a machine and a plurality of punches are mounted on the gate of the machine to reciprocate with the gate toward and from the dies. The invention is specifically directed to means for adjusting the positions of the punches relative to the dies. While not so limited, the invention may be advantageously employed in a machine called a header wherein one or more dies sequentially cooperate with two or more punches for performing heading operations on a workpiece.

It is, of course, known that when a header is set up, the punches must be properly positioned with respect to the dies so that the punches and dies are in axial alignment when cooperating with one another. In the two-blow header, means are provided to shift the punches vertically or transversely so that first one punch and then the other punch is in axial alignment with the single die. In such a situation, the alignment of each punch with the single die is made more difficult by the shiftability of the punches. One of the major problems in assuring the axial alignment of the punches is the accessibility of the punch mounting to the operator. Whether the machine be a vertical or horizontal header, the provision of the numerous mechanical elements place working space at a premium. Visibility, as well as accessibility are usually hampered in machines of this type and this is particularly true in double-blow headers where punch-shifting mechanisms must be provided cooperating with the means mounting the punches to the gate of the header.

It is accordingly an object of the invention to provide improved means for effecting fine adjustment of the positions of a plurality of punches carried by a header.

It is another object of the invention to provide punch adjusting means with remote controls which are operable from readily accessible points.

It is a further object of the invention to provide punch adjusting means which is adapted for use with a double two-blow header wherein the punch holders are reciprocated vertically.

It is yet another object of the invention to provide certain improvement in the form, construction and arrangement of the several parts whereby the above-named and other objects may effectively be attained.

The invention accordingly comprises the features of construction, combination of elements, and arrangement of parts which will be exemplified in the constructions hereinafter set forth, and the scope of the invention will be indicated in the claims.

Practical embodiments of the invention are shown in the accompanying drawings, wherein.

Figure 1:
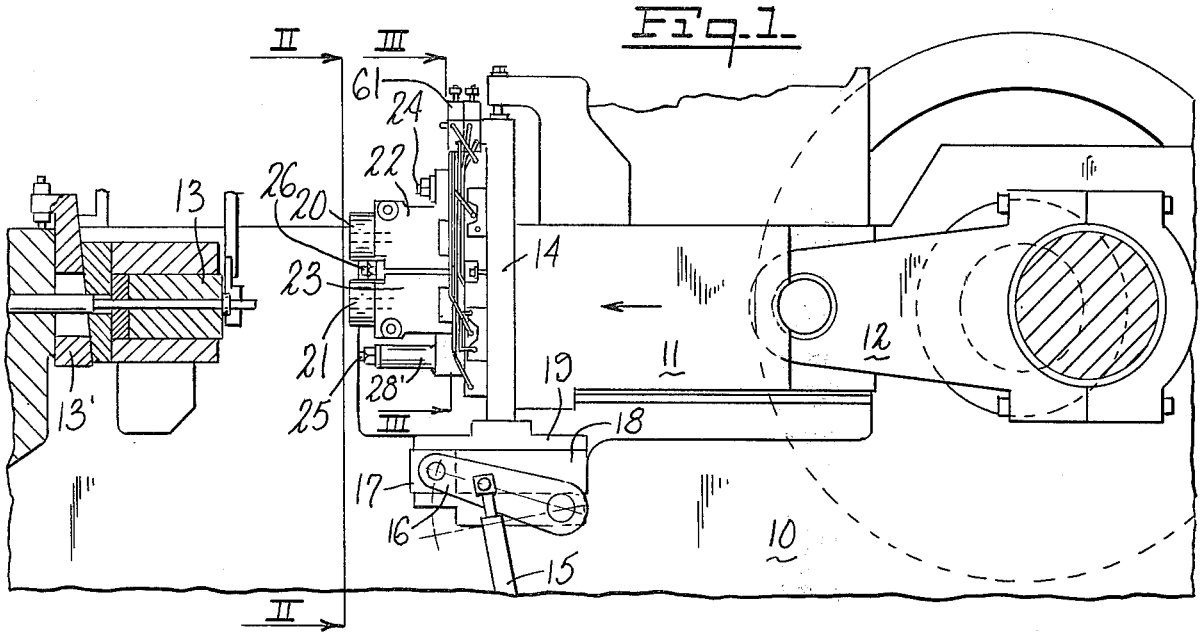
FIG. 1 represents a side elevation of the pertinent portions of a two-blow header, the die block and its mounting being in section, and the punch adjusting means being hydraulic.

Referring to the drawings, the machine embodies a frame 10 in which is slidably mounted a ram or gate 11, operated by any suitable mechanism such as the pitman 12 and which moves the ram horizontally toward and from the fixed die 13 supported in the frame 10, the die being adjustable forward and back by the well known wedge indicated at 13'. A vertically reciprocating punch-carrying slide 14 is mounted on the front end of the gate or ram 11, and guided in its reciprocation by any suitable guiding means on the ram.

Figure 2:
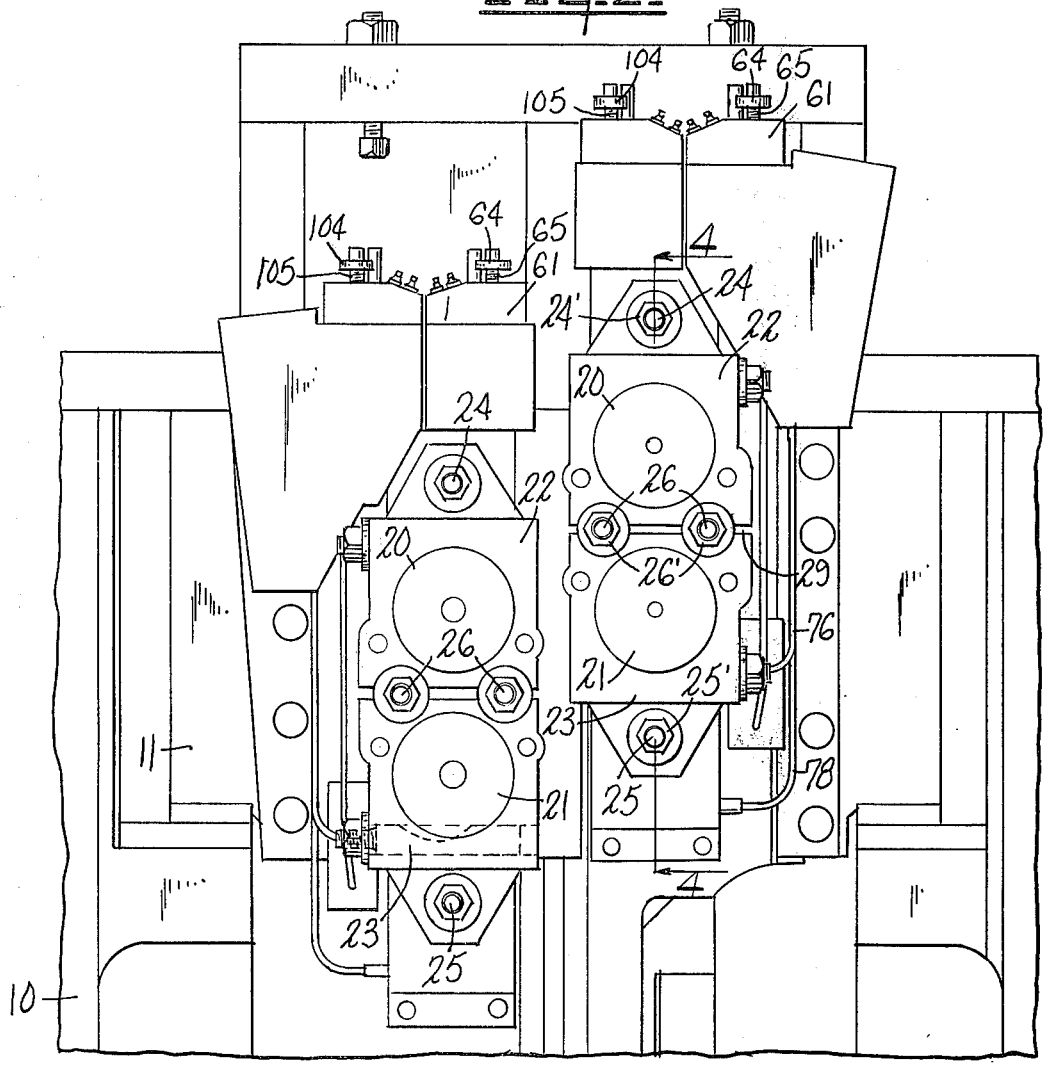
FIG. 2 represents an elevational view of the punch side of the machine as viewed from the line II—II of FIG. 1.

The slide is actuated by a drive rod 15, acting through a lever 16, and block 17 in a horizontal track 18 in the slide base 19 which reciprocates vertically with the slide and horizontally with the gate. The rod 15 is driven from an auxiliary drive shaft, not shown in synchronism with the gate drive. As shown in FIG. 2, the machine is a double two-blow header having a pair of punch-carrying slides which are mirror duplicates of each other, the punches acting on workpieces held in a pair of fixed dies 13, and being reciprocated in cycles 180° apart. The following description will be directed to the elements shown at the right of FIG. 2, with the understanding that it applies, mutatis mutandis, to the left-hand unit also.

The punches 20,21 are mounted in punch carriers 22,23, which, in turn, are bolted adjustably to the slide 14 by means of upper and lower fixed studs 24,25 and intermediate studs 26, each with a nut 24', 25', 26', respectively. The upper and lower studs pass through enlarged holes 27,28 in upward and downward projecting parts, respectively, of the upper and lower punch carriers 22,23, and are threaded and welded into cylindrical members 30 which are held against turning by pins 31 in the slide. The intermediate studs 26 are elongated and similarly secured at horizontally spaced points in enlarged openings in the space 29 between adjacent horizontal edges of the carriers, at positions near the outer ends of the punch holders 22,23. Each nut applies its holding force through a washer which overlies the adjacent carrier surface. The holes 27,28 have substantially greater diameters than the studs 24,25 and the enlargements of space 29 are greater than the diameter of studs 26 so that, when all nuts are loosened, the punch carriers can be moved in any direction in the plane of the slide face, to bring each punch into proper operating alignment with its die. When moved to such positions the tightening of the nuts will cause each washer to clamp against the adjacent carrier surface, thus fixing the punches in their required positions. The lower stud 25 is shown as being elongated and passing through a sleeve 28' which serves to extend the hole 28 and to place the nut 25' in a more accessible position. This invention is particularly directed to the means for moving the carriers to their adjusted position, and holding them there while the nuts are tightened.

The punch carrier 22 rests against the upper backing plate 32 which is traversed by a substantially square aperture 33, and is set into the face of the slide 14, as indicated at 34. An annular collar 35 with four flattened sides projects from the rear of the carrier into the aperture 33, the bore of the collar forming an extension of the hole 27 and the vertical side surfaces of the collar being slidable between the vertical sides of the aperture. Said lower and upper edges are further stabilized, for vertical movement, by blocks 120,121, sliding in slots 122,123 extending up and down in the faces of the respective plates from the adjacent edges, the blocks being held stationary in the base of the punch carrier by lugs 124,125 extending, with a close fit, into short bores in the punch carrier.

The backing plate is bored vertically, through the center of the aperture 33, to form a cylindrical cavity 36 extending downward from the aperture into the plate and a coaxial cylindrical chamber 37 extending upward from the aperture to the top edge of the plate. The plate is also bored horizontally to form hydraulic fluid passages 38, to the cavity 36, and 39, to the chamber 37, respectively. The cavity 36 is provided with a piston 40, adapted to bear against the flat bottom surface of the collar 35, and the chamber 37 is sealed, as by a plug 41, and provided with a piston 42 bearing against the flat upper surface of the collar 35.

The punch carrier 23 rests against a lower backing plate 32' and is mounted in a similar manner, the hole 28 being extended by a collar 45 (like collar 35) extending into a square aperture 43 (like aperture 33) and the plate being bored to form a cavity 46 extending upward from the aperture 43 into the plate and a coaxial cylindrical chamber 47 extending downward from the aperture to the bottom edge of the plate. The plate is bored horizontally to form hydraulic fluid passages, 48 to the cavity 46 and 49 to the chamber 47. The cavity 46 is provided with a piston 50, adapted to bear against the flat upper surface of the collar 45, and the chamber 47 is sealed by a plug 51 and provided with a piston 52 bearing against the flat bottom surface of the collar 45.

Figure 3:
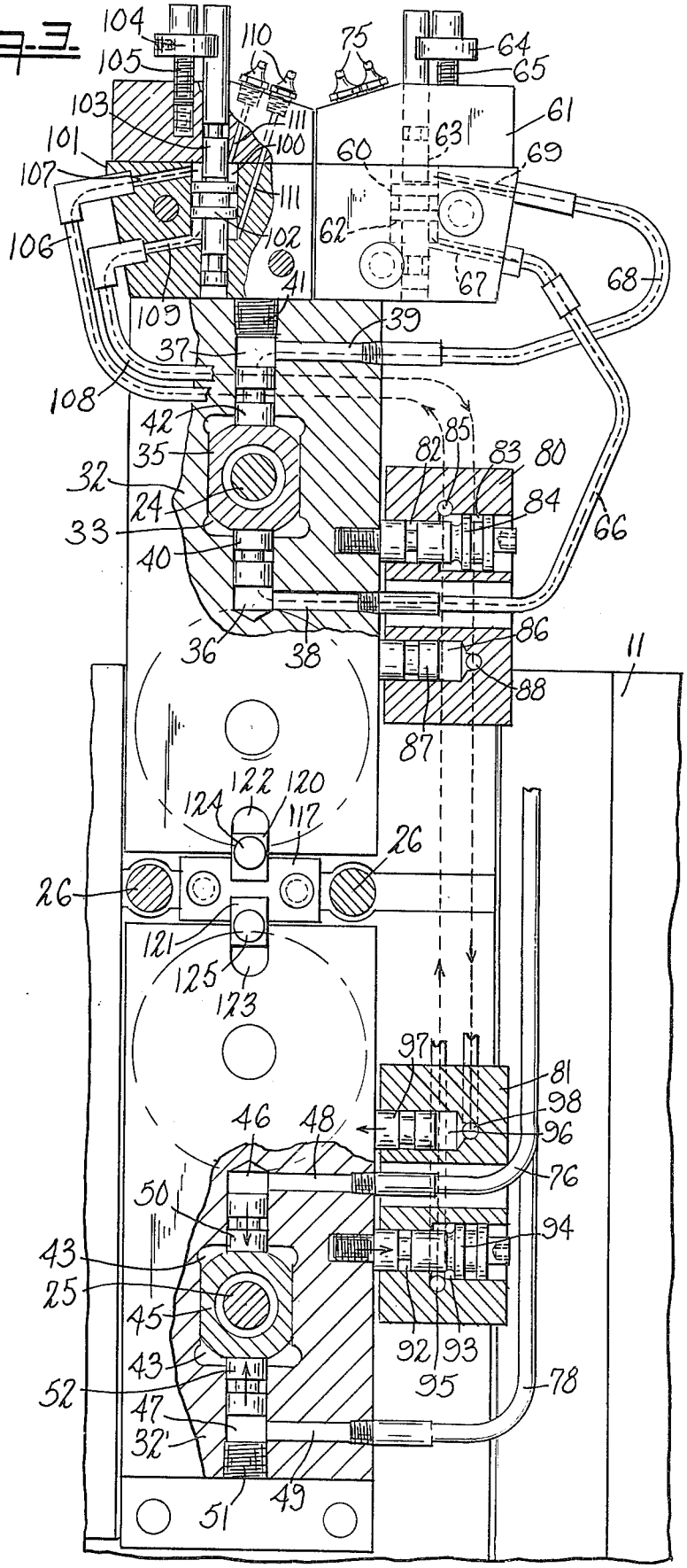
FIG. 3 represents a sectional view on the line III—III of FIG. 1.

The upwardly and downwardly acting pistons 40,42 and 50 and 52 are the working elements in hydraulic systems for effecting independent fine vertical adjustment of the respective punch carriers 22 and 23, as shown particularly in FIG. 3.

The circuit for operating the pistons 40 and 42 includes the master cylinder 60 in a cylinder block 61 fixed to the upper portion of the slide 14, the cylinder containing a piston 62 carried on the end of a plunger 63 which projects from the top of the block and is laterally slotted to be engaged with the disc 64 threaded on a stud 65. The passage 38 from cavity 36 is connected by the conduit 66 and passage 67 to the master cylinder 60 at a point below the piston 62, and the passage 39 from the cavity 37 is connected by a conduit 68 and passage 69 to the master cylinder at a point above the piston.

The circuit for operating the pistons 50 and 52 (acting on collar 45) is the same as just described, the conduits 76 and 78 being connected to a master cylinder assembly, not shown, located at the top of the slide adjacent the cylinder 60 and adjustable in the same manner.

A suitable hydraulic fluid is supplied to both sides of each system through inlet fittings 75 which communicate with the master cylinder 60 at points above and below the piston 62. The volume of each hydraulic system is constant. From the description above it will be seen that (assuming that nuts 24', 25' and 26' are loosened) adjustment upward of the piston 62 forces fluid through passage 69, conduit 68, and passage 39 into chamber 37 to drive downward the piston 42, and collar 35 which is fixed on the punch carrier. The downward pressure on collar 35 urges downward the piston 40 in chamber 36 and the fluid in said chamber flows to the master cylinder through passage 38, conduit 66 and passage 67, to maintain full the portion of the master cylinder below the upwardly moved piston 62. Any movement in either direction of the piston in the master cylinder is reflected in corresponding precisely controlled vertical movement of the respective punch carrier.

For horizontal adjustment of the punch carriers the elements include upper and lower control blocks 80,81 which are fixed on the slide adjacent one side of the upper and lower backing plates 32, 32', respectively. The block 80 is provided with a bore 82 extending to the side next to the backing plate and having an enlarged cylindrical portion 83, adapted to receive the piston 84, constituted by the outer end of a stud which is screwed into the plate 32. A passage 85 opens into the cylinder 83 beneath the piston head, whereby increased hydraulic pressure will tend to draw the plate 32 toward the block 80. The block is provided also with a cylindrical chamber 86 containing a free piston 87, one end of which rests against the side of the plate 32. A passage 88 for hydraulic fluid opens into the cylinder 86, whereby increased hydraulic pressure in said cylinder tends to push the plate 32 away from the block 80. The master cylinder and connections for lateral adjustment of the upper plate 32 are not shown, but are the same as described below in connection with the lower plate 32'.

The lower block 81 is constructed in the same manner, having a bore 92 with cylinder 93 and piston 94 connected to the plate 32', the passage 95 opening into the cylinder beneath the piston head. The cylindrical chamber 96 contains a free piston 97 resting against the side of plate 32' and the passage 98 opens into the cylinder 96. The complete hydraulic circuit includes the master cylinder 100 in a cylinder block 101 fixed to the upper portion of the slide 14, adjacent to the block 61, the cylinder containing a piston 102 carried on the end of a plunger 103 which projects from the top of the block and is laterally slotted to be engaged with the disc 104 threaded on a stud 105. The passage 95 from the cylinder 93 is connected by the conduit 106 and passage 107 to the master cylinder at a point above the piston 102, and the passage 98 from chamber 96 is connected by the conduit 108 and passage 109 to the master cylinder at a point below the piston. The fittings 110, on the upper ends of supply passages 111, provide communication with the master cylinder 100 at points above and below the piston so that the system can be kept completely filled with hydraulic fluid.

Lateral adjustment of the plate 32′ is effected by screwing the disc 104 up or down to move correspondingly the piston 102. Downward movement of the piston forces fluid through the passage 109, conduit 108 and passage 98 to the chamber 96 where piston 97 acts on the adjacent side of the plate 32′ to push it to the left, in FIG. 3. Such movement of the plate decreases the volume of the chamber 93 (under the head of piston 94) and forces a corresponding amount of fluid through passage 95, conduit 106 and passage 107 into the master cylinder chamber 100, above the piston. Upward movement of the piston causes flow and movement in the reverse direction, the flow into chamber 93 causing the piston head 94 to move toward the right, as shown in FIG. 3.

The facing lower edge of the upper plate 32 and upper edge of the lower plate 32′ are rabbetted as shown at 115 and 116, respectively, both rabbets being engaged, for free sliding horizontally, by a key 117 of T-shaped cross-section.

To permit adjustment in any direction of the punches 20,21 each of the nuts 24′, 25′, 26′ must be loosened slightly; each punch may be adjusted independently of the other, e.g., to adjust punch 20, loosen nuts 24′ and 26′. The adjustment of the alignment of each punch is effected by actuation of the pistons in the respective master cylinders, as described above, and the nuts are then tightened, locking the punches in their proper positions.

The nuts 24′, 25′ and 26′, by which the punch carriers are secured in their operating positions, are readily accessible on the face of the machine, the nuts 25′ and 26′ being brought out to convenient locations by the sleeve 28′ and by the extension of the adjacent punch carrier walls, respectively. Punch adjustment is effected, not by devices located inaccessibly under or near the punches, but by the simple manipulation of the hydraulic circuit controls conveniently located on top of the machine.

Figures 8, 9:
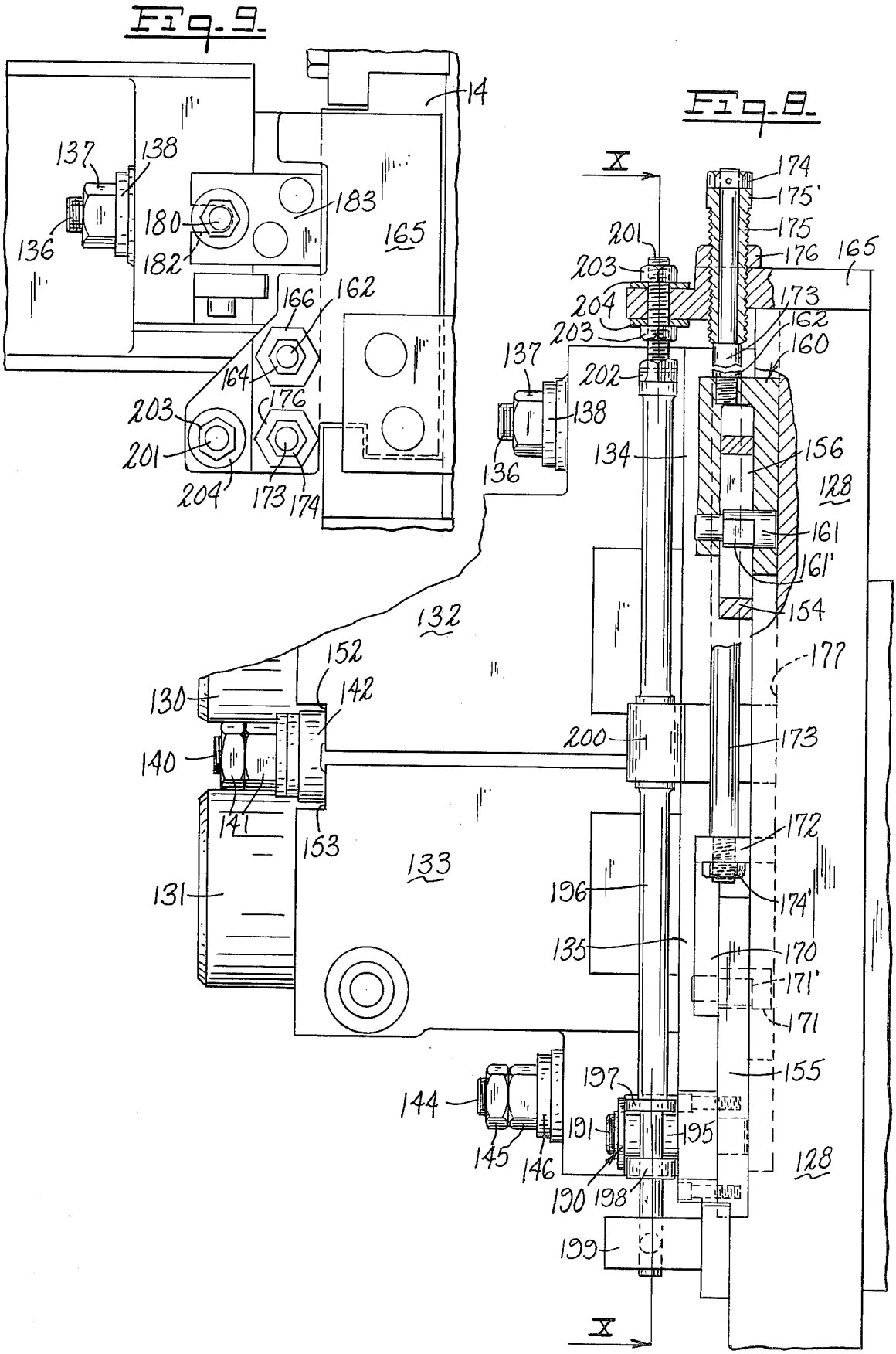
FIG. 8 represents a detail side elevation, partly in section, showing a modified form wherein mechanical elements replace the hydraulic system of FIGS. 1 to 7.
FIG. 9 represents a top plan view of the parts shown in FIG. 8.
Figure 10:
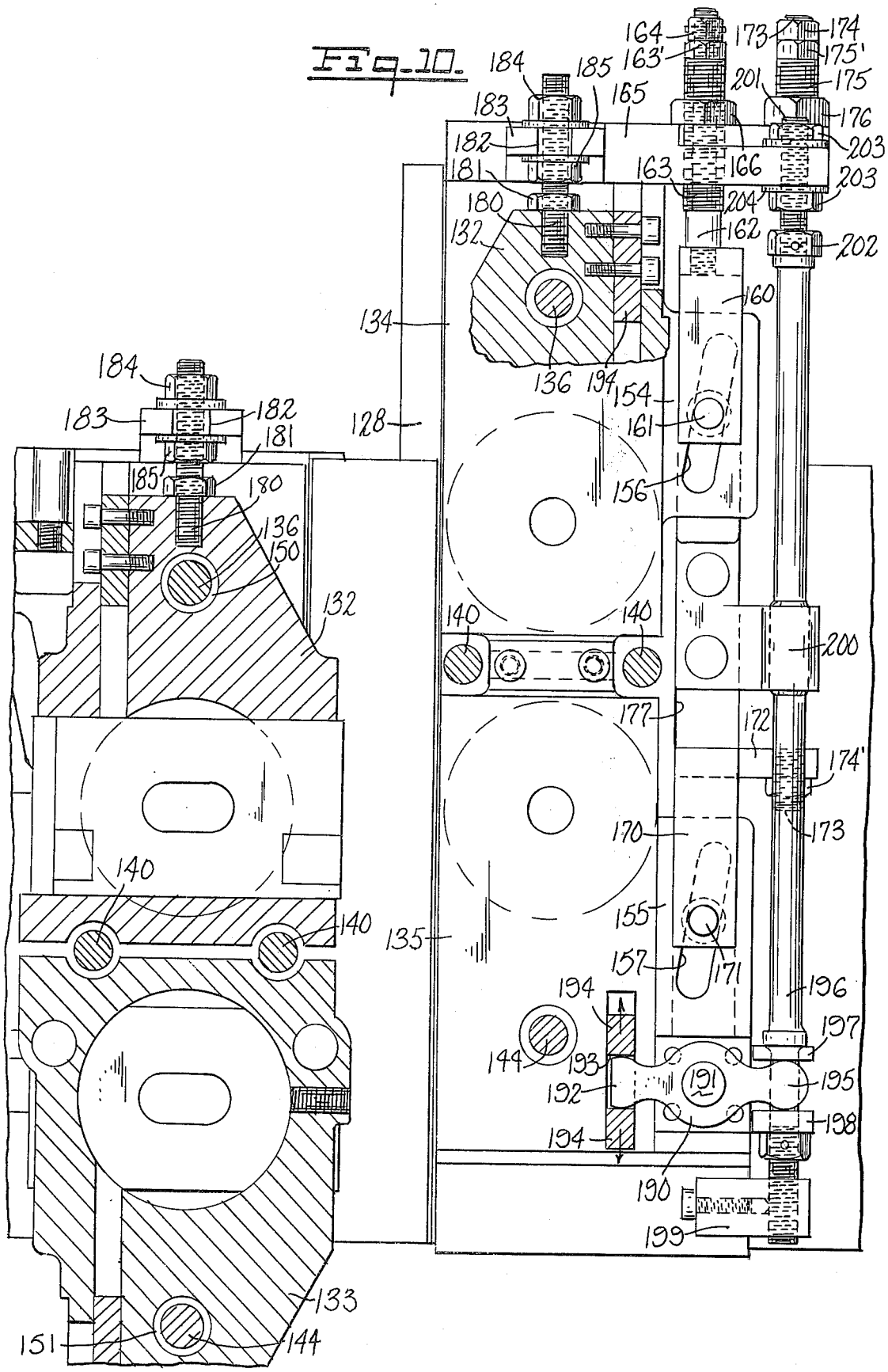
FIG. 10 represents a vertical section on the line X—X of FIG. 8, certain parts being omitted for illustrative purposes.

Alternative means for effecting fine adjustment of the punch from remote points at the top of the machine are shown in FIGS. 8, 9 and 10, wherein the hydraulic systems described above are replaced by mechanical elements. The machine is basically the same double two-blow header referred to above, the die elements being not shown and the description being directed mainly to the mounting and adjustment control for the punches 130,131 shown at the right in FIG. 10. The slide 128 corresponds to the slide 14 in FIG. 1.

Each punch is mounted in a punch carrier 132,133, respectively, and these are bolted adjustably to backing plates 134,135, by means of the upper stud 136 with nuts 137 and washer 138, the intermediate studs 140 with nuts 141 and a pressure plate 142, and the lower stud 144 with nuts 145 and washer 146. The studs 136 and 144 pass through bores 150 and 151 with sufficient clearance to permit any necessary fine adjustment of the carriers, and the pressure plate 142 bears against shoulders 152,153 on adjacent edges of the punch carriers, also with sufficient clearance for adjustment.

Each backing plate is formed with a lateral extension 154,155, the extensions being provided with cam slots 156,157 which are straight and angled a few degrees from the vertical. The arms of an upper clevis 160 pass each side of the extension 154 and a pin 161, having flattened sides 161′, is mounted in the clevis and passes through the cam slot 156 with a close sliding fit. The clevis 160 is mounted on the end of a rod 162 which passes through a threaded sleeve 163 which is held on the rod by means of a pinned nut 164 at the top. The sleeve is threaded through a mounting plate 165 fixed to the top of the slide and is provided with a hex portion 163′ and a locking nut 166.

The arms of the lower clevis 170 pass each side of the extension 155 and a pin 171, having flattened sides 171′, is mounted in the clevis and passes through the slot 157 with a close sliding fit, as in the case of pin 161 in slot 156. The clevis 170 is carried by short horizontal plate 172, fastened on the lower end of the rod 173 by means of the nut 174′. The rod 173 extends to the top of the machine where it is provided with a threaded sleeve 175 held by a pinned nut 174, threaded through the plate 165 and held by locking nut 176, as described in connection with the rod 162. The sleeve has a hex portion 175′. The clevises 160 and 170 are guided in the vertical slot 177 in the slide 128.

Vertical adjustment of the rods 162 and 173 effects horizontal fine adjustment of the backing plates 134 and 135 by the action of the pins 161 and 171 in their respective cam slots 156 and 157, as will be clear from the foregoing description of the several parts and their interrelation. Vertical fine adjustment of the upper punch carrier 132 is effected very directly by means of the stud 180, threaded into the top of the punch carrier and secured there by the lock nut 181, the stud extending through a slot 182 in the mounting plate 183 fixed on the top of the backing plate 134. The vertical position of the stud is determined by the nuts 184,185 above and below the plate 183, in an obvious manner.

Vertical movement of the lower punch carrier 133, for fine adjustment thereof, is effected by means of a rocker 190, pivotally mounted at 191 on a lower portion of the extension 155 of backing plate 135. The rocker has one arm 192 engaged in a slot 193 between rearwardly extending portions 194 of the punch carrier 133, the other arm 195 of the rocker being in the form of a clevis the sides of which pass each side of the drive rod 196 between upper and lower stop washers 197,198. The drive rod has its lower end threaded and screwed into the block 199 which is fixed on the lower end of the slide 128, the rod being supported medially by a bracket 200 and terminating upward in a threaded portion 201 which passes through an extension of the plate 165. Adjacent to the portion 201 is a hex portion 202 and lock nuts and washers 203,204 are carried by the portion 201 above and below the plate.

When the nuts 203 are loosened a wrench can be applied to the hex 202 for rotation of the rod 196, screwing it up or down in the block 199 and thus effecting vertical movement in the opposite direction of the punch carrier 133, assuming that nuts 141 and 145 on studs 140 and 144 are loosened to permit adjustment. The punches, punch carriers, backing plates and slide shown at the left of FIG. 10 are equipped with vertical and horizontal adjusting mechanisms of the same character.

Figure 7:
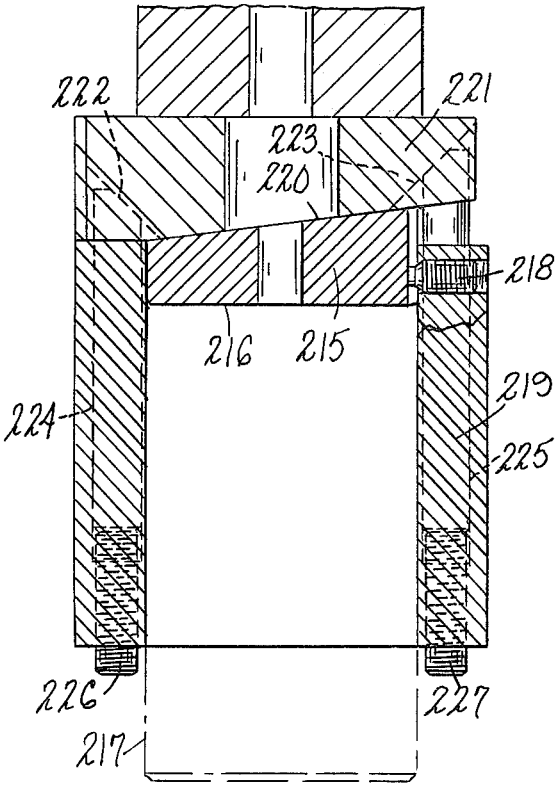
FIG. 7 represents a detail horizontal section on the line VII—VII of FIG. 6.

The mechanism described above is adapted for effecting fine adjustment of the punches up and down and/or laterally, either by the hydraulic circuits of FIGS. 1 to 4 or by the mechanical means shown in FIGS. 8 to 10. In either case, as in most headers, means must also be provided for making a fine adjustment of the forward limit of travel of each punch. A wedge arrangement, interposed at some convenient point between the drive and the punch holder, is commonly used as shown in Hoyt U.S. Pat. No. 3,101,632 where the wedge is located between the pitman and the gate. In the present case a wedge 221 (FIG. 7) is spaced from the back surface 216 of the punch 217 (corresponding to punches 20 or 130) by a wedge-shaped spacer 215, the latter's position being controlled by the set screw 218 in the adjacent wall of the punch carrier 219. The slanted surface 220 of the wedge rests against a correspondingly angled surface on the spacer, the wedge having beveled surfaces 222,223 at each end and its position being determined by the reciprocal adjustment of bevel-ended slides 224,225 under the control of set screws 226,227 in the front face of the punch carrier. To effect in-and-out adjustment of the punch, the screws 226 and 227 are turned to force the wedge 221 to the right or left until the punch is in its proper position.

As noted above, the retaining nuts 24', 25' and 26' on studs 24,25,26 are in relatively accessible positions on the face of the punch side of the machine, but the accessibility of the intermediate and lower ones depends somewhat on their being located near the forward ends of the punch holders. In FIGS. 11,12,13 and 14 there is shown alternative retaining means with remote control therefor, somewhat similar to the remote control of adjustment described in connection with FIGS. 8,9 and 10.

Figure 11:
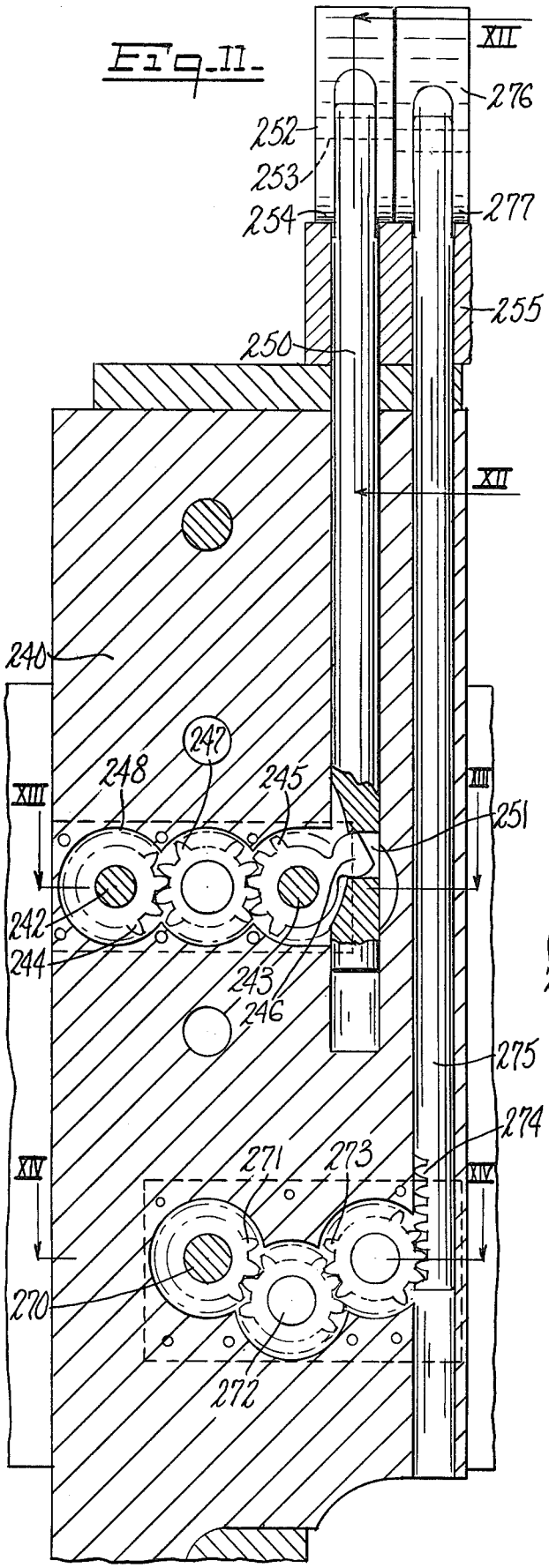
FIG. 11 represents a detail vertical section of a punch slide showing alternative means for releasing the clamp screws in combination with either of the means disclosed above.

In FIG. 11, the element 240 corresponds functionally to the slide 14 in FIGS. 1 to 4, for purposes of illustration. The studs 242,243 correspond to studs 26, and stud 270 corresponds to stud 25. In each case the keyed and welded securement of the studs 25 and 26, described above, is replaced by the provision of threaded pinion lockup systems.

Referring to the studs 242,243, the lock-up system includes a pinion 244 threaded on the end of stud 242, a threaded gear segment 245 threaded on the end of stud 243 and an intermediate pinion 247 engaging the pinion 244 and segment 245. These parts are set in a recess 248 in the rear surface of the slide and protected by a cover plate 249. Each stud is keyed as indicated at 242',243' to prevent rotation with the respective threaded elements 244,245, so that turning of said elements can cause only axial movement of the studs.

Figure 12:
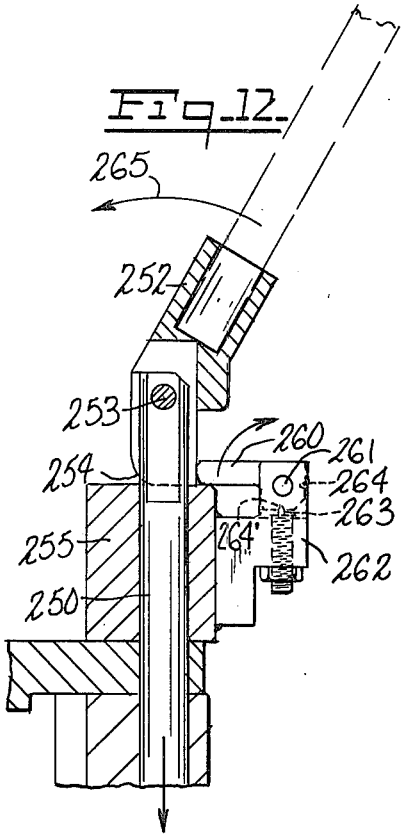
FIG. 12 represents a detail vertical section on the line XII—XII of FIG. 11.
Figure 13:
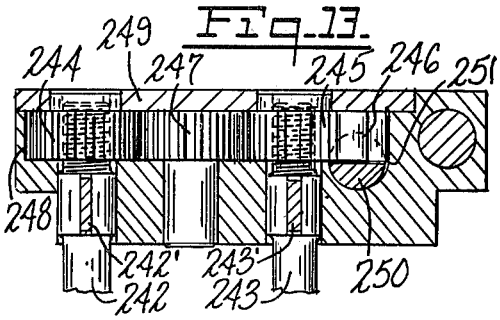
FIG. 13 represents a horizontal section on the line XIII—XIII of FIG. 11.
Figure 14:
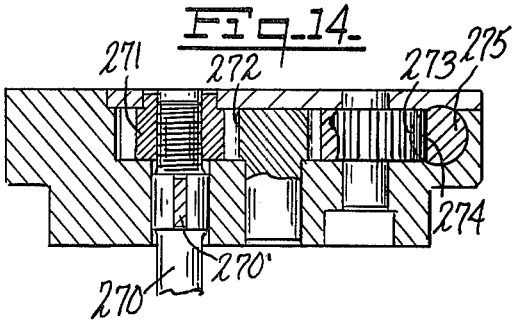
FIG. 14 represents a horizontal section on the line XIV—XIV of FIG. 11.

The gear segment 245 has a radially projecting arm 246 with arcuate upper and lower surfaces, and the actuating rod 250 has an aperture 251 in which the arm 246 fits with free frictional engagement, the rod extending to the top of the machine where it is equipped with a handle 252, pivoted at 253 and having a cam extension 254. As shown in FIG. 12, when the cam extends downward against the block 255 the rod 250 is lifted and the gear elements 244 and 245 are rotated counter-clockwise (FIG. 11) tightening them on their respective studs, if a right-hand thread is used. The cam is held in the position of FIG. 12 by a stop lever 260 pivotally mounted at 261 on an extension 262 of the block 255. A spring actuated detent 263 holds the stop lever releasably in its stop position by engagement in the notch 264 or, when the stop lever is turned 90° to its release position, it is held there by engagement of the detent in the notch 264', on the base of the stop lever. When released, the lever and cam can be rotated in the direction of the arrow 265 to lower the rod 250, thus loosening the threaded gear elements 244,245 on their respective studs as required to permit fine adjustment of the punch carriers to their adjusted positions. If the rod 250, when released, does not drop to the release position by gravity, it can be tapped with a hammer.

Figure 4:
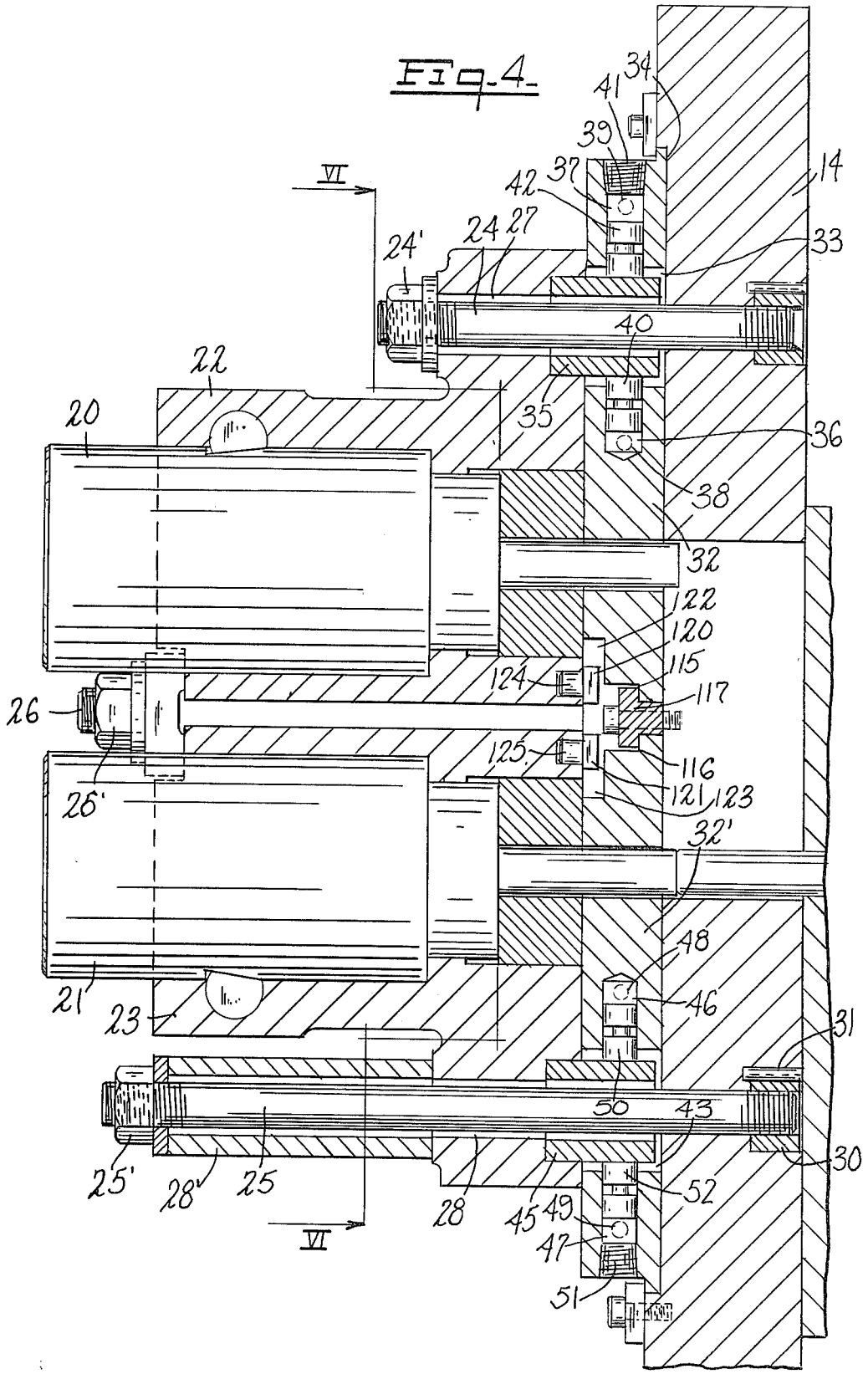
FIG. 4 represents a detail vertical section on the line IV—IV of FIG. 2.
Figure 5:
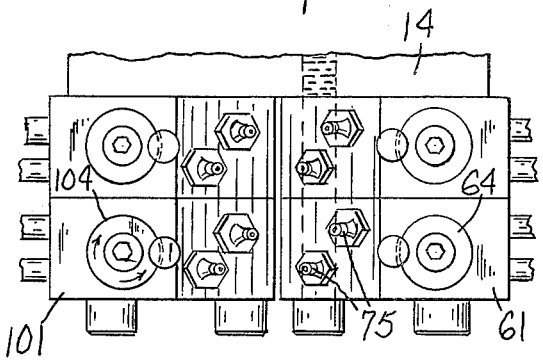
FIG. 5 represents a detail top plan view of parts shown at the top of FIG. 3.
Figure 6:
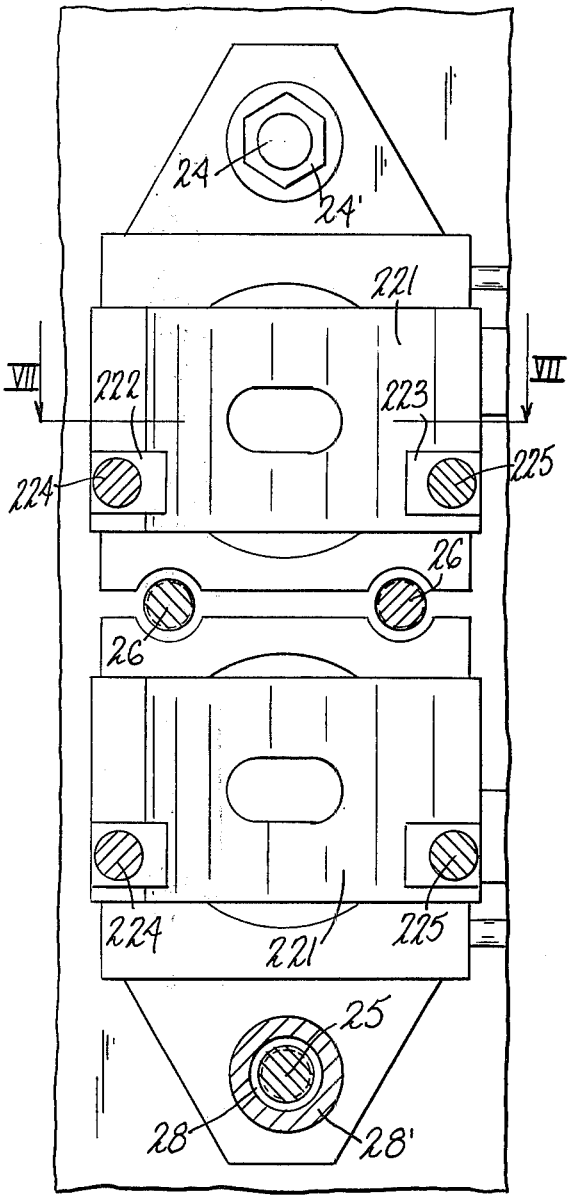
FIG. 6 represents a vertical section on the line VI—VI of FIG. 4.

The stud 270, near the bottom of FIG. 11, corresponds to stud 25 in FIG. 4 and its lock-up system includes the threaded pinion 271 and intermeshed pinions 272 and 273, the latter engaging a rack 274 on the side of the actuating rod 275. The stud 270 is keyed in the slide as shown at 270' (FIG. 14) to prevent rotation while permitting axial movement. The rod 275 extends to the top of the machine where it is moved up and down by a handle 276 and cam 277 operating as described above in connection with the parts 252–254, 260–264.

When the lock-up mechanism just described is used, and a punch carrier such as the one held by studs 242,243 and 270 requires fine adjustment, each rod 250 and 275 is released (referring to rod 250) by swinging stop lever 260 to its release position and moving the handle 252 and cam 254 counter-clockwise (FIG. 12), rod 275 being similarly released, so that each can move downward to rotate the threaded elements 244, 245 and 271 through about 160° to adjustability looseness, the downward movement being aided by a hammer tap, if necessary. When the fine adjustment has been effected by the hydraulic or mechanical means described herein, or in any other manner, the handles 252,276 are returned to the locking positions indicated in FIGS. 11 and 12, raising the rods 250 and 275 and thus tightening each element 244,245 and 271 to its operating tightness. The respective stop levers 260 are dropped into place, as in FIG. 12, to prevent unwanted loosening.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

What we claim is:

1. Means for adjusting the position of a punch carried by a vertically movable slide in a header having releasable means for fixing the punch in operative position, comprising, for each punch, a backing plate slidably adjustable laterally relative to the slide, a punch carrier slidably adjustable vertically relative to the backing plate, means for applying oppositely vectored vertical forces to the punch carrier, means for applying oppositely vectored horizontal forces to the backing plate, means for actuating selectively said force applying means, all said actuating means being located remote from the points of application of said forces and in readily accessible positions adjacent the top of the slide, and force transmitting means operatively connecting said actuating means with the respective force applying means.

2. Adjusting means according to claim 1 wherein the force applying means are included in closed hydraulic systems.

3. Adjusting means according to claim 2 wherein the means for applying forces to the punch carrier include pistons contacting oppositely facing horizontal surfaces of the punch carrier, a closed hydraulic circuit which includes means for biasing said pistons in opposite vertical directions and means for holding said pistons in their respective adjusted positions.

4. Adjusting means according to claim 2 wherein the means for applying forces to the backing plate include a piston contacting a vertical surface of the backing plate, a piston connected to the backing plate, a closed hydraulic circuit which includes means for biasing said pistons in opposite horizontal directions, and means for holding said pistons in their respective adjusted positions.

5. Adjusting means according to claim 2 wherein the means for applying forces to the punch carrier include pistons contacting oppositely facing horizontal surfaces of the punch carrier, a first closed hydraulic circuit which includes means for biasing said pistons in opposite vertical directions and means for holding said first named pistons in their respective adjusted positions, and the means for applying forces to the backing plate include a piston contacting a vertical surface of the backing plate, a piston connected to the backing plate, a second closed hydraulic circuit which includes means for biasing said two last named pistons in opposite horizontal directions, and means for holding all said pistons in their respective adjusted positions.

6. Adjusting means according to claim 5 wherein the biasing means are master cylinders containing two-way pistons with piston-actuating means, each piston head being interposed in a closed hydraulic circuit such that piston movement in either direction causes hydraulic fluid movement out of the cylinder toward a respective first or second piston and simultaneous fluid movement into the cylinder away from an oppositely moving first or second piston.

7. Adjusting means according to claim 1 wherein the force applying means are mechanical elements.

8. Adjusting means according to claim 7 wherein the force applying means comprise angled cams and axially movable rods operatively connected to said cams.

9. Adjusting means according to claim 7 which includes a rocker and an axially movable rod, the rocker having one end movably engaged with the rod and its other end movably engaged with the punch.

10. Adjusting means according to claim 8 wherein said cams and rods are operatively associated with the backing plate.

11. Adjusting means according to claim 9 wherein said rocker and rods are operatively associated with the punch carrier.

12. Adjusting means according to claim 1 wherein the means for fixing the punch in operative position include studs mounted in the slide by adjustable means, which adjustable means comprise threaded pinions and actuating means for said pinions.

13. Adjusting means according to claim 12 wherein the pinion actuating means comprise axially movable rods each operatively engaging one pinion, and means for holding said rods in different adjusted positions.

14. In a header having a punch carrier adjustably secured to a slide by at least one stud having a free end and a relatively fixed end, lock-up means comprising a threaded element on the free end adapted for tightening against the punch carrier, a threaded element on the relatively fixed end and remotely actuated means for rotating said last named threaded element between a locked-up position and a slightly released position.

15. In a header according to claim 14, lock-up means wherein the remotely actuated means comprise threaded pinions.

16. In a header according to claim 15, lock-up means wherein the remotely actuated means comprise axially movable rods each operatively engaging one pinion, and means for holding said rods in different adjusted positions.

* * * * *